US008734263B2

(12) United States Patent
Ford et al.

(10) Patent No.: US 8,734,263 B2
(45) Date of Patent: May 27, 2014

(54) FLOORING SYSTEM FOR BOWLING ALLEY

(75) Inventors: Gary J. Ford, Chesterfield, VA (US); Mark D. Kilpatrick, Richmond, VA (US); Phillip W. Whitaker, Jr., Mechanicsville, VA (US)

(73) Assignee: Qubicaamf Worldwide LLC, Mechanicsville, VA (US)

( * ) Notice: Subject to any disclaimer, the term of this patent is extended or adjusted under 35 U.S.C. 154(b) by 3013 days.

(21) Appl. No.: 10/814,226

(22) Filed: Apr. 1, 2004

(65) Prior Publication Data

US 2005/0221904 A1 Oct. 6, 2005

(51) Int. Cl.
*A63D 1/04* (2006.01)

(52) U.S. Cl.
USPC ..... 473/115

(58) Field of Classification Search
USPC ..... 473/115, 116
See application file for complete search history.

(56) References Cited

U.S. PATENT DOCUMENTS

| | | | | | |
|---|---|---|---|---|---|
| 631,090 | A | * | 8/1899 | Mussey | 473/115 |
| 2,039,580 | A | * | 5/1936 | Borders | 473/115 |
| 2,969,983 | A | * | 1/1961 | De Vore | 473/115 |
| 4,036,496 | A | | 7/1977 | Robinson | |
| 4,139,671 | A | | 2/1979 | Kelly et al. | |
| 4,146,223 | A | * | 3/1979 | Stottman | 473/115 |
| 4,169,602 | A | * | 10/1979 | Heddon | 473/115 |
| 4,199,881 | A | | 4/1980 | Francis | |
| 4,205,842 | A | | 6/1980 | Murrey, Sr. | |
| 4,205,843 | A | | 6/1980 | Murrey, Sr. | |
| 4,221,620 | A | | 9/1980 | Milne | |
| 4,231,573 | A | | 11/1980 | Kelly | |
| 4,244,570 | A | | 1/1981 | Murrey, Sr. | |
| 4,269,411 | A | | 5/1981 | Heddon | |
| 4,307,883 | A | | 12/1981 | Kelly | |
| 4,311,177 | A | | 1/1982 | Kelly | |
| 4,320,898 | A | * | 3/1982 | Brunst et al. | 473/117 |
| 4,330,122 | A | | 5/1982 | Sheinberg et al. | |
| 4,336,937 | A | | 6/1982 | Kelly | |
| 4,337,290 | A | | 6/1982 | Kelly et al. | |
| 4,337,291 | A | | 6/1982 | Kelly | |
| 4,354,678 | A | | 10/1982 | Heddon | |
| 4,361,615 | A | | 11/1982 | Kelly | |
| 4,368,898 | A | | 1/1983 | Lay | |
| 4,379,553 | A | | 4/1983 | Kelly | |

(Continued)

OTHER PUBLICATIONS http://www.sawdustmaking.com/About%20Joints/about_joints.htm, Sawdust Making 101—a guide for the beginning woodworker, about finger joints, 2003.*

*Primary Examiner* — William Pierce
(74) *Attorney, Agent, or Firm* — Andrew M. Calderon; Roberts Mlotkowski Safran & Cole, P.C.

(57) ABSTRACT

A prefabricated flooring system used in a section of a bowling lane such as an approach section. The flooring system includes a plurality of wooden boards having a longitudinal axis. The plurality of wooden boards each having substantially flat side edges along the longitudinal axis. Interior boards of the plurality of wooden boards are bonded together by an adhesive applied on the side edges and two of the outermost boards of the plurality of boards are bonded only on one side edge by the adhesive to adjacent corresponding interior boards to form a preformed approach section of wooden boards. In one aspect, the boards have a thickness of approximately that of the bowling lane. In another aspect, the preformed approach section has a width greater than that of the bowling lane.

34 Claims, 4 Drawing Sheets

(56) References Cited

U.S. PATENT DOCUMENTS

| | | | | |
|---|---|---|---|---|
| 4,406,455 | A | | 9/1983 | Berry et al. |
| 4,406,456 | A | | 9/1983 | Berry et al. |
| 4,420,155 | A | | 12/1983 | Sheinberg et al. |
| 4,421,309 | A | | 12/1983 | Heddon |
| 4,437,010 | A | | 3/1984 | Scheie et al. |
| 4,441,710 | A | | 4/1984 | Lay |
| 4,456,253 | A | | 6/1984 | Kelly |
| 4,507,035 | A | | 3/1985 | Monett |
| 4,580,780 | A | | 4/1986 | Gautraud et al. |
| 4,599,124 | A | | 7/1986 | Kelly et al. |
| 4,664,377 | A | | 5/1987 | Ayre, Jr. |
| 4,674,745 | A | | 6/1987 | Speranza |
| 4,746,560 | A | | 5/1988 | Goeden |
| 4,770,419 | A | | 9/1988 | Libby |
| 4,779,868 | A | | 10/1988 | Ayre, Jr. |
| 4,792,136 | A | | 12/1988 | Dulisse |
| 4,795,152 | A | | 1/1989 | Suiter |
| 4,796,887 | A | | 1/1989 | Sternhagen |
| 4,801,143 | A | | 1/1989 | Heddon |
| 4,856,138 | A | | 8/1989 | Ingermann et al. |
| 4,867,816 | A | | 9/1989 | Suiter |
| 4,900,024 | A | | 2/1990 | Chandler et al. |
| 4,913,433 | A | | 4/1990 | Rochefort |
| 4,944,514 | A | | 7/1990 | Suiter |
| 5,084,318 | A | | 1/1992 | Stirling et al. |
| 5,154,418 | A | | 10/1992 | Wortman |
| 5,181,716 | A | | 1/1993 | Stephens |
| 5,183,262 | A | | 2/1993 | Heddon |
| 5,207,422 | A | | 5/1993 | Beene |
| 5,219,412 | A | | 6/1993 | Kubo |
| 5,226,649 | A | | 7/1993 | Beirne, Jr. et al. |
| 5,238,242 | A | | 8/1993 | Edwards |
| 5,275,397 | A | | 1/1994 | Heddon |
| 5,297,998 | A | | 3/1994 | Greiner |
| 5,304,097 | A | | 4/1994 | Duff |
| 5,316,521 | A | | 5/1994 | Ayre, Jr. |
| 5,322,476 | A | | 6/1994 | Wortman |
| 5,330,412 | A | | 7/1994 | Stephens |
| 5,348,513 | A | * | 9/1994 | Heddon ..... 473/117 |
| 5,374,220 | A | | 12/1994 | Burtchett |
| 5,380,251 | A | | 1/1995 | Heddon |
| 5,405,295 | A | | 4/1995 | Lord |
| 5,411,442 | A | | 5/1995 | Stephens et al. |
| 5,415,591 | A | | 5/1995 | Beene |
| 5,417,616 | A | | 5/1995 | Widrick |
| 5,435,788 | A | | 7/1995 | Duff |
| 5,449,326 | A | | 9/1995 | File |
| 5,466,193 | A | | 11/1995 | Hixson |
| 5,472,381 | A | | 12/1995 | Ayre, Jr. |
| 5,489,241 | A | | 2/1996 | Perrier |
| RE35,232 | E | | 5/1996 | Stephens |
| 5,521,393 | A | | 5/1996 | Burkholder et al. |
| 5,540,624 | A | | 7/1996 | Hixson |
| 5,888,142 | A | * | 3/1999 | Perrier ..... 473/54 |
| 6,450,892 | B1 | | 9/2002 | Burkholder et al. |
| 6,645,082 | B1 | | 11/2003 | Lessard et al. |

* cited by examiner

FLOORING SYSTEM FOR BOWLING ALLEY

BACKGROUND OF THE INVENTION

1. Field of the Invention

The invention generally relates to a flooring system for bowling lanes and, more particularly, to a prefabricated flooring system for a bowling lane approach section.

2. Background Description

Bowling has increased in popularity over the years, both at the professional and amateur levels. In fact, over the years, bowling has also been increasing in popularity as a recreational sport, which can be shared by family members and friends, alike. To most enjoy the bowling experience, however, it is important to have properly maintained bowling lanes and approach sections, as well as other types of equipment ranging from bowling balls to bowling shoes.

In conventional systems, tongue and groove hardwood blocks or planking is used in both the bowling lane and the approach section. In bowling lane applications, the wood construction consists of several planks or boards that are about 2¾ inch in thickness, and about one inch in width, as measured in the edgewise direction. In the approach sections, the wood planking may be the same thickness in front of the lane (e.g., head section). At the sides of the approach, however, the approach section may have a smaller thickness since these sections (i) do not have the same traffic, and (ii) include an under track which can then be more easily maintained.

The wood boards are joined together along the tongue and groove edges, and then nailed, screwed or otherwise fastened to one another in the horizontal direction, i.e., along the width from one edge to another edge. The nails may join approximately three boards together. To ensure that the wood boards do not splinter during the nailing process, the thickness of the wood planking in the bowling lane and approach section must be about 2¾ inch thick or greater. After the nailing, the edge panels are "sized" e.g., planed, to fit the width of the bowling lane and approach section, and then fastened to the underlying base such as, for example, a plywood base via screws, dowel rods or other known fasteners. Once the panels are properly laid, they are varnished or lacquered to maintain the integrity of the floor, itself.

To maintain the flooring systems in working condition, the wood planking must be periodically refurbished by sanding in order to reduce damage caused by ball release, which is intensified by lofting of the ball in the approach section. That is, ball release causes, upon impact, dents, pock marks and other damage in the head of the lane and the approach section. Warping and other types of distortions also occur over the years due to moisture and wear, which also must be addressed periodically by sanding. Also, it is known that refurbishment is necessary to meet set bowling standards and in order to provide uniformity of all lanes.

In sanding the wooden flooring system, the head of the lane and the approach sections are typically sanded more aggressively than that of the remaining portions of the lanes, themselves. This is mainly due to the fact that more damage occurs in theses sections. However, in either the bowling lane or the approach section, it is well known that sanding reduces the longevity of the wood planking. This is mostly due to the fact that sanding removes a layer or certain thickness from the wood planking and eventually exposes the nails or other fastening devices in the wood, itself. But, aggressive sanding is the only way to remove the dents and other impact damage in the wood planking.

The aggressive sanding in the approach and lane head section results in more wear in these sections. Thus, the exposure of the nails or other fasteners would result sooner in these areas than in the remaining areas of the bowling lane if the thickness was the same. Thus, it is important to have an initial thickness of the wood boards to ensure that the replacement of the bowling lane does not occur often, thus resulting in down time.

The replacement of the wood planking is very time consuming and expensive. Although this is not performed very frequently on each lane, it certainly can be envisioned that many bowling lanes must be closed for a considerable period of time in order to replace or repair the wood planking. This, of course, decreases the amount of lanes available to the bowler, thus decreasing the profitability of the bowling alley.

Over the years, much advancement has been made to bowling alleys and in particular the flooring systems of bowling alleys. This ranges from the materials used on the flooring system to the installation and upkeep of these flooring systems. For example, synthetic laminate flooring systems, i.e., high pressure laminate systems, have gained popularity amongst bowling alley purveyors due to the ease of installation, the reduction in maintenance, longer lasting life, reduced impact damage (e.g., denting) from bowling balls and a host of other factors. Thus, the use of laminate flooring systems can lead to reduced overhead costs to the bowling alley purveyors, themselves. This, in turn, will then reduce costs for the bowling alley patrons.

However, hardwood flooring systems in the approach section still appeal to the "purists". In essence, the hardwood flooring systems provide known slide characteristics that are preferred by many bowlers. So, to appeal to these bowlers, many bowling alleys were retrofitted with a laminated lane, while maintaining a hardwood approach section. This approach was thought to solve many problems by reducing the maintenance of the bowling lane.

However, after extended use, the hardwood approach section may also become severely worn. In these instances, there are options which the purveyors of the bowling alley have to make. One option is to place laminate flooring systems in the approach area. This option, though, does not appeal to the purists. In another option, a new hardwood flooring system may be laid in the approach section. Although this option appeals to the purists, it was found that material cost, installation cost and yearly maintenance cost are prohibitive. By way of one example, the varying thickness of the wood flooring of the approach section and the laminate flooring of the lanes requires sanding of the approach section which wastes material and is very time consuming.

The invention is directed to overcoming one or more of the problems as set forth above.

SUMMARY OF THE INVENTION

In a first aspect of the invention, a prefabricated flooring system is used in a bowling lane. In one application this prefabricated flooring system may be used for the approach section. The flooring system includes a plurality of wooden boards having a longitudinal axis. The plurality of wooden boards each having substantially flat side edges along the longitudinal axis. Interior boards of the plurality of wooden boards are bonded together by an adhesive applied on the side edges and two of the outermost boards of the plurality of boards are bonded only on one side edge by the adhesive to adjacent corresponding interior boards to form a preformed section, e.g., approach section or bowling lane, of wooden boards. In one aspect, the boards have a thickness of approximately that of a laminate panels of the bowling lane. In another aspect, the preformed approach section has a width greater than that of the bowling lane.

In another aspect of the invention, a bowling alley flooring system comprises a bowling lane and a prefabricated approach section abutting the bowling lane. The prefabricated approach section includes a plurality of wooden boards each having side edges along the longitudinal axis. The plurality of wooden boards are bonded together by an adhesive applied on the side edges. The prefabricated approach section has a thickness approximately the same as that of laminate panels of the bowling lane.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF EMBODIMENTS OF THE INVENTION

The invention is directed to a prefabricated flooring system used in a bowling alley. This prefabricated flooring system is applicable to both new installations and retrofit installations. In one application, the invention is directed to a prefabricated wood flooring system which can be provided in the approach section of the bowling lane or a section of the approach lane, nearest the foul line and preferably extending about 6 feet therefrom. By using the prefabricated wood flooring system of the invention, the thickness of the wood boards of the approach section can be considerably reduced to, in instances, less than that of conventional systems and can approach the thickness of the laminate bowling lane. This decreases many installation problems. Thus, the installation time of the flooring system in the approach section (or other areas) can be significantly reduced, thus saving time and expense in the installation thereof. The prefabricated flooring system is also resistant to warping, i.e., piano keying, and other damage.

Flooring System of the Invention

Figure 1:
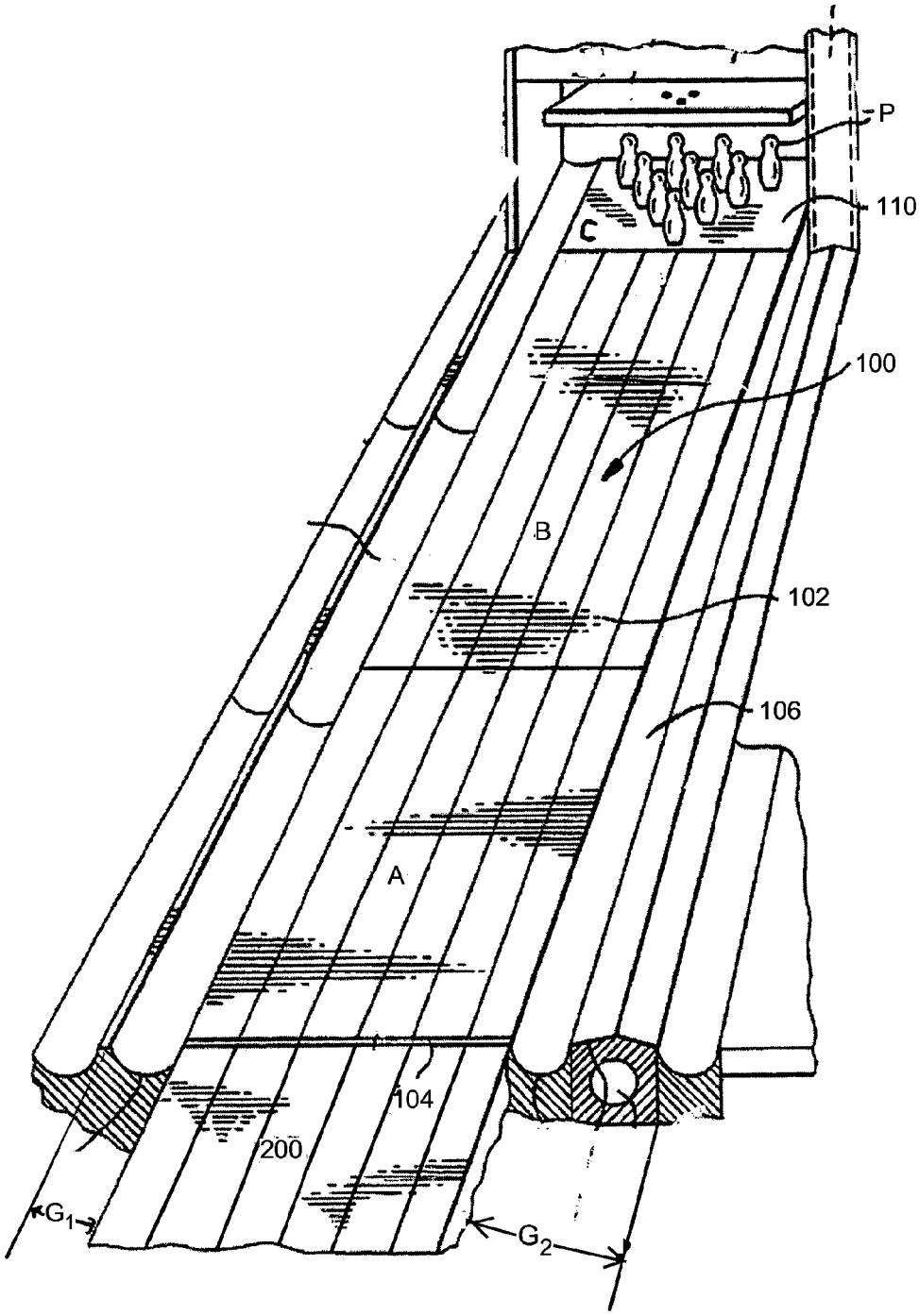
FIG. 1 shows a schematic diagram of a bowling lane and approach section in accordance with the invention.

Referring now to FIG. 1, a diagram of the flooring system of the invention is shown. In the embodiment of FIG. 1, the flooring system includes a bowling lane depicted as reference numeral 100 and an approach section generally depicted as reference numeral 200. The bowling lane 100 is a longitudinally extending lane having a plurality of parallel abutting strips of wood 102. In one aspect, each of the abutting strips of wood 102 is laid in a conventional manner and is approximately 2¾ inches in thickness to, amongst other reasons, prevent splintering from the horizontal nails applied during the installation process. However, the lanes may also be fabricated in accordance with the invention, as discussed below. In other implementations, the lane is made of a laminate sheet, without the requirement for individual boards. The thickness of the laminate is typically ½ inch thick or less than that of wooden floors.

At one end of the bowling lane 100 is foul line 104 which extends across the abutting strips 102, perpendicular to the longitudinal axis of the bowling lane. The gutters 106 receive any errand balls that are bowled toward either side of the bowling lane 100. A pin deck 110 is at an end of the bowling lane 100 and is adapted to receive a plurality of bowling pins "P".

Still referring to FIG. 1, the approach section 200 abuts the foul line 104 and extends to and in aspects past the gutters 106 disposed along a side of the bowling lane 100, as shown by reference to "$G_1$" and "$G_2$". As should be well understood, though, the approach section of the invention may be the same, less than or greater than the width of the bowling lane, depending on a desired application. However, in one application, the preferred size of the prefabricated approach section (s) is the width of the lane in addition to the area shown as reference "$G_1$" and "$G_2$". This increases the size of the approach section thus reducing even further installation time at the site. The approach section 200, which may be prefabricated in accordance with the invention, is also made from strips of abutting wood such as maple or beech or other known hardwoods. In one aspect of the invention, only a section of the approach area is prefabricated in accordance with the invention, with other portions being a laminate or synthetic product or the residual wooden approach section. In this scenario, it is preferable that the approach area nearest the foul line be made of the wood material to retain the preferred slide characteristics.

In one application, the bowling lane is divided into three sections, "A", "B" and "C". Section "A" is the head/arrow section, adjacent to the foul line 102. Section "B" is the pine section and section "C" is the pin deck area. In this application, the bowling lane, in total, is approximately 25, 35 and 4 feet, respectively, in length. In the wood planking application, the section "A", which is a high impact area, may be a hard wood where the remaining sections are a softer wood for example, pine. It should be understood that the invention should not be limited to the use of beech, maple and pine, and other materials may equally be used with the invention. For example, the bowling lane 100 may be a high pressure laminate flooring system, approximately 42 inches in width (from edge to edge).

Figure 2A:
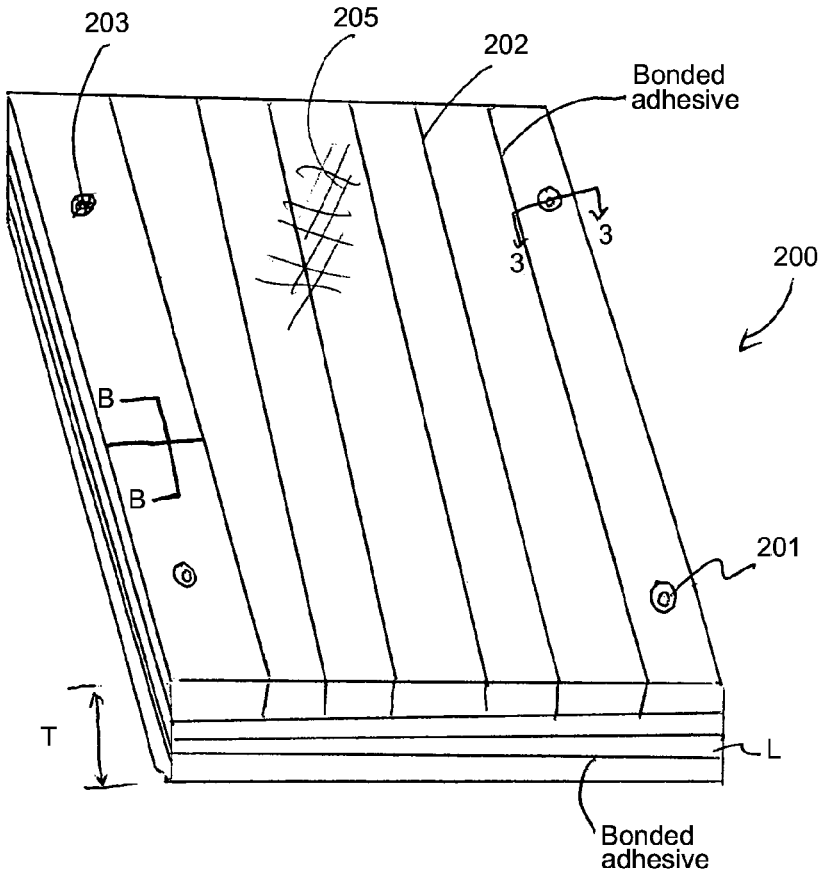
FIG. 2*a* shows a flooring system of the approach section in accordance with the invention.

FIG. 2*a* shows the wood planking of the approach section 200 in more detail. It should be recognized that the wood planking of FIG. 2*a* may equally represent the flooring on the bowling lane or a section of the approach section. Generally, hereinafter reference is mostly made to the approach section, but this should not be a limiting feature of the invention. The wood planking of the approach section 200 includes several boards that are prefabricated, e.g., glued or cured, at the longitudinal and transverse edges 202 prior to the laying of the panels at the site. In one implementation, the panels are bonded together using, for example:

(i) cold or hot pressed curing adhesives;
(ii) air drying PVA (Polyvinyl acetates) adhesives;
(iii) hot melt urethanes; or
(iv) radiation curing using, for example, microwave, ultraviolet light or low voltage electron beams to excite the water molecules to provide heat and accelerate curing.

PVA applications are designed to work on porous materials such as wood and can be used to provide enhanced adhesive properties. PVA applications are also easy to work with since they are water based adhesives and do not emit any harmful fumes, and are not hazardous to touch. Additionally, PVA can set at room temperature. Also, in some instances, sawdust can be added to increase the gap filling ability of the joined edges.

The panels of the approach section 200 may also have a durable finish such as a UV curable finish, e.g., polyurethane based materials, shown as reference numeral 205. It is known that curable finishes are stronger than that of water or solvent based finishes. The use of the adhesives and/or the curable finishes will enhance the durability of the wood floors, i.e., increased wear and dent resistance, reduced warping and the like.

Also, to add even more durability to the system, the prefabricated flooring system may include an underlay, e.g., one or more layers of product, under the wood flooring. The underlay may be attached to the prefabricated flooring system via any known bonding adhesive or other fastening methods such as screws. FIG. 2*a* may also equally represent the installation of the prefabricated flooring system on an underlay already laid in the approach section, for example, at the bowling center.

The underlying layer or layers, designated as "L", may be manufactured from a synthetic material such as medium density fiber (MDF) or high density fiber (HDF) boards or oriented strand board (OSB) or high density particle board (HDP), which is less expensive than that of the wood upper layer. The underlay also may be representative of the already existing approach section, whether that be a synthetic laminate or wood. Depending on the application and desired thickness of the approach section 200, any number of underlay layers can be applied to the wooden top layer. The underlying layers can also increase the durability features of the prefabricated flooring system, e.g., reduce warping, due to the properties of the underlying MDF or HDF, etc.

In the applications of the invention, the flooring system can be readily prefabricated at the factory in order to reduce installation time at the bowling alley. The approach section 200 can also be pre-finished with a varnish or a lacquer or other durable UV cure finish prior to installation at the bowling alley. Both prefabrication and the prefinishing will add strength to the flooring system making it more durable and less wear and dent resistant. This, in turn, will maintain the bowling lane in operable condition for a longer period of time and hence increase profitability. The prefabrication of the approach section can also be used for retrofitting of this section when replacing other wood approach floors or laminate floors.

Also, in these applications, nailing of the boards is no longer required in the horizontal direction, thereby reducing the likelihood of splintering of the wood during fabrication. In this manner, the thickness of the wood floors may be reduced considerably since there is no need to maintain the thicker floor due to the splintering. For example, in some retrofit applications, the thickness "T" of the approach section 200 can be reduced to less than 2¾ inches to match the thickness of the flooring on the bowling lane. In one preferred application, the thickness can approach downwards of ¾ inches in thickness or less. This reduced thickness helps in the installation process due to less weight which, in turn, translates into the need for less wood, and hence less cost for the purchase of the wood.

Another advantage of the system of the invention is the elimination of the tongue and groove system. That is, the side edges are flat. This feature will eliminate any stresses that form at the tongue and groove connection thus eliminating any potential cracking or splintering of the wood boards. Additionally, additional sanding may be accomplished during the life time of the product without concern for contacting of a groove, which would then require replacement of the floor.

The system of the invention may also be used with synthetic laminate bowling lanes. When using this combination, the thickness of the wood boards of the approach section may be reduced to approximately the same thickness of the synthetic laminate panels, ¾ inches in thickness, compared to approximately ½ inches in thickness for the laminate floor. This eliminates the need for additional sub flooring or excessive shimming on the bowling lane, thereby reducing costs.

It should further be understood that the approach section 200 can now be manufactured to any desired size or shape at the factory. In one application, the approach section will extend between the gutters, approximately 42 inches wide, which is the width of the bowling lane. In another application, the approach section 200 may be fabricated in sections totally filling the width of the lane in addition to the gutter area designated as "$G_1$" and "$G_2$" of FIG. 1. In this latter application, the larger approach section 200 will result in faster installation. In addition, the wood panels are also fabricated in a section of approximately 30 inches to accommodate the area designated as G' in FIG. 1, e.g., ball return track and fill areas.

Figure 3:
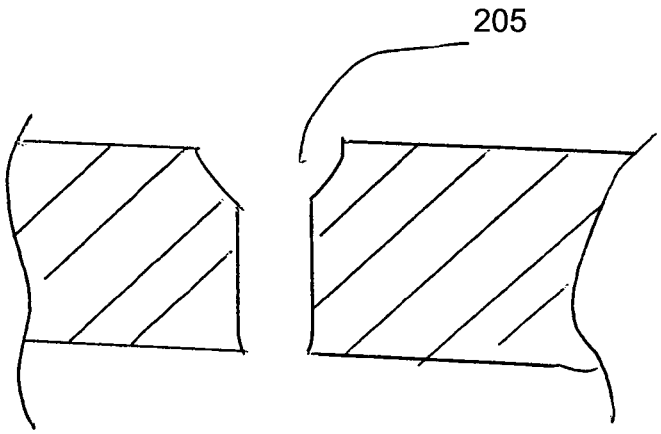
FIG. 3 shows a cross sectional view of a counter sunk hole along line 3-3 of FIG. 2*a*.

As further shown in FIG. 2*a*, the prefabricated approach section 200 may also include predrilled countersunk holes 201. FIG. 3 shows a cross sectional view of the counter sunk holes along line 3-3 of FIG. 2*a*. The predrilled countersunk holes 201 will accommodate nails, screws or other fastening devices for fastening approach section to a sub floor in the bowling alley. The predrilled countersunk holes 201 may also be used to insert plugs 203 for covering the nails, screws or other fastening devices. Also, the holes 201 may be used for the insertion of contrasting dowels 203, used as range finders. In this latter aspect, the plugs 203 will be of a contrasting color, i.e., different species of wood or synthetic material. The predrilled countersunk holes 201 will decrease the installation time since the installer will no longer need to drill holes, provide for countersinks and the like at the installation site.

Figure 2B:
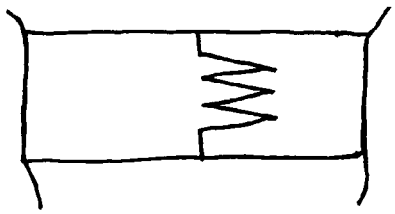
FIG. 2*b* shows a cross sectional view along line B-B of FIG. 2*a;*

FIG. 2*b* shows a cross sectional view of the wood planking along line B-B of FIG. 2*a*. It is seen in this cross sectional view that the transverse side edges of adjacent boards are abutting to one another via an interleaved finger joint. In this manner, the adhesive is placed between the interleaved finger joints connect or bond the flooring panels to one another at the short or transverse edges. This allows the panels to be longer in length. Additionally, by providing the interleaved finger joints, the prefabricated section has increased strength and better withstands ball impact and other stresses. This configuration also prevents "piano keying" from occurring during the life of the prefabricated section.

Figure 4A:
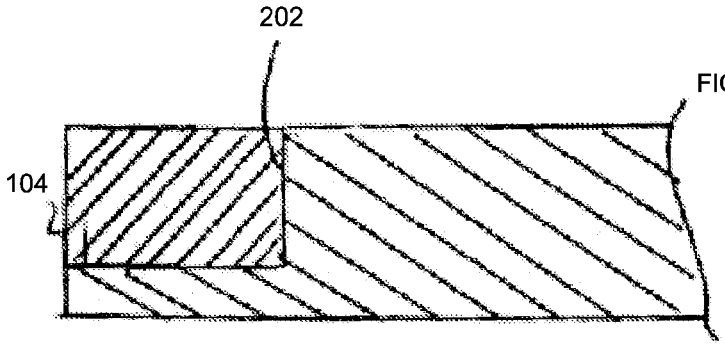
FIGS. 4*a* to 4*e* are cross sectional views of the approach section with an integrated foul line in accordance with the invention.
Figure 4B:
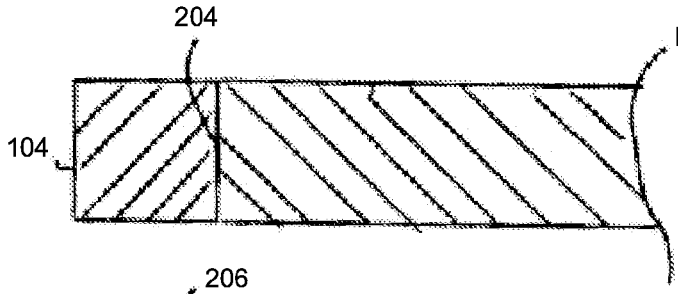
Figure 4C:
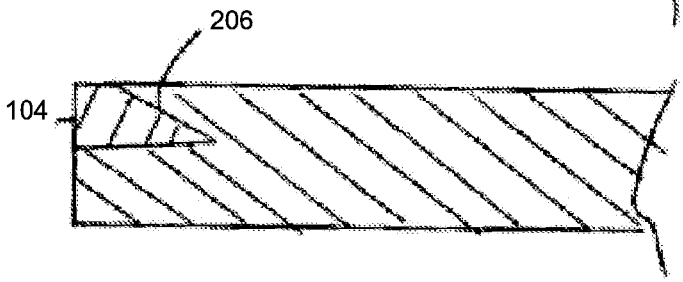
Figure 4D:
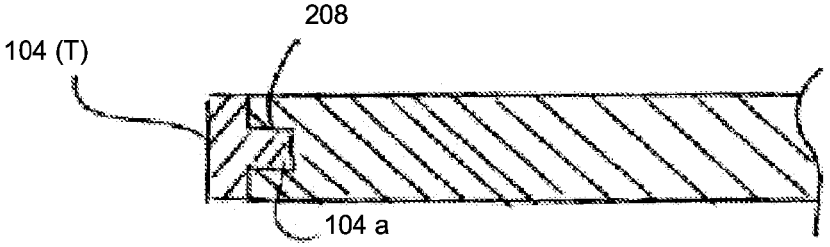
Figure 4E:
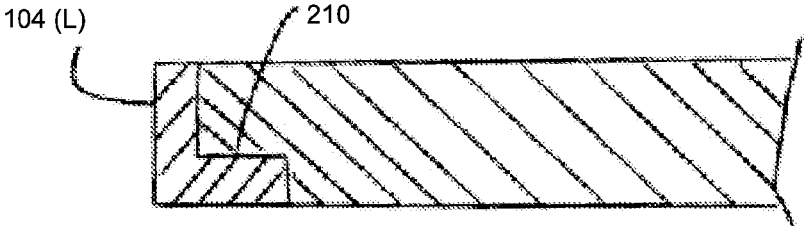

FIGS. 4*a* to 4*e* are different cross sectional views of the approach section with an integrated foul line. In FIG. 4*a*, the prefabricated approach section includes a squared milled section 202 in which the foul line 104 is placed therein. FIG. 4*b* shows the foul line 104 abutting an edge 204 of the prefabricated approach section 200. In FIG. 4*c*, the foul line 104 is fitted into an angled milled portion 206 of the prefabricated approach section 200. In FIG. 4*d*, a groove 208 is milled into the edge of the prefabricated approach section 200 and a leg 104*a* of a "T" shaped foul line 104 is inserted therein. A portion of the "T" shaped foul line will extend to the surface of the prefabricated approach section. In FIG. 4*e*, a groove 210 is milled in the underside of the prefabricated approach section and an "L shaped foul line 104 is inserted within the groove, where a portion of the "L" shaped foul line will extend to the surface of the prefabricated approach section.

In each of these implementations of FIGS. 4*a* to 4*e*, the foul line is preferably glued to the prefabricated approach section in a manner similar to that of the panels. The integration of the foul line enhances the ease of installation of the approach section. By way of example, in removing a preexisting floor, it is now possible to remove the foul line, as well, without concern for damaging the foul line.

While the invention has been described in terms of embodiments, those skilled in the art will recognize that the invention can be practiced with modification within the spirit and scope of the appended claims.

Having thus described our invention, it is claimed:

1. A prefabricated flooring system adapted for use in a bowling center, comprising a plurality of wooden boards having a longitudinal axis, the plurality of wooden boards each having substantially flat side edges along the longitudinal axis, interior boards of the plurality of wooden boards being bonded together by an adhesive applied on the side edges and two of the outermost boards of the plurality of wooden boards being bonded only on one side edge by the adhesive to adjacent corresponding interior boards to form a preformed section of wooden boards, and an integrated foul line of contrasting material bonded to an edge of the preformed section of wooden boards substantially perpendicular to the longitudinal axis, wherein the integrated foul line is bonded to a milled portion in the edge of the plurality of wooden boards.

2. The system of claim 1, wherein a thickness of the plurality of wooden boards is less than 2¾ inches.

3. The system of claim 1, wherein a thickness of the plurality of wood boards is approximately ¾ inches.

4. The system of claim 3, wherein the prefabricated flooring system is used in an approach section of a bowling lane and is greater than 42 inches in width.

5. The system of claim 1, wherein the adhesive is one of:

(i) cold or hot pressed curing adhesive;

(ii) air drying PVA (Polyvinyl acetates) adhesive;

(iii) hot melt urethanes; and (iv) radiation curing adhesive.

6. The system of claim 1, wherein the prefabricated preformed section is used as a section of an approach section of a bowling lane.

7. The system of claim 6, wherein remaining sections of the approach section are synthetic boards.

8. The system of claim 1, further comprising a finish on the wooden boards.

9. The system of claim 1, wherein the preformed section of wooden boards includes an underlayment.

10. The system of claim 9, wherein the underlayment is at least one layer of fiberboard.

11. The system of claim 10, wherein the fiberboard is medium density fiber (MDF) or high density fiber (HDF) board or oriented strand board (OSB) or high density particle board (HDP).

12. The system of claim 11, wherein the underlayment is bonded to the plurality of wooden boards by adhesive or fastening device.

13. The system of claim 1, wherein the milled portion is a groove.

14. The system of claim 13, wherein the groove is located at (i) a middle of the edge such that the foul line is a T shape, (ii) a bottom of the edge such that the foul line is an L shape or (iii) a top of the edge such that the foul line is a block.

15. The system of claim 1, wherein a width of the preformed section of wooden boards is greater than a bowling alley lane.

16. A prefabricated flooring system adapted for use in a bowling center, comprising a plurality of wooden boards having a longitudinal axis, the plurality of wooden boards each having substantially flat side edges along the longitudinal axis, interior boards of the plurality of wooden boards being bonded together by an adhesive applied on the side edges and two of the outermost boards of the plurality of wooden boards being bonded only on one side edge by the adhesive to adjacent corresponding interior boards to form a preformed section of wooden boards, wherein the preformed section of wooden boards is a prefabricated sectioned approach section totally filling an area of the bowling lane in addition to gutter area.

17. The system of claim 1, wherein the preformed section of wooden boards is approximately equal to a width of a bowling alley lane.

18. The system of claim 1, wherein the preformed section includes drilled holes for the insertion of fasteners for fastening to a sub floor.

19. The system of claim 18, further comprising plugs for plugging the drilled holes.

20. The system of claim 1, further comprising contrasting dowels used as range finders.

21. The system of claim 1, wherein the plurality of wooden boards include abutting short edges joined by an interleaved finger joint.

22. A bowling alley flooring system comprising:

a bowling lane; and a prefabricated approach section abutting the bowling lane, the prefabricated approach section comprising:

a plurality of wooden boards having a longitudinal axis, the plurality of wooden boards each having side edges along the longitudinal axis, the plurality of wooden boards being bonded together by an adhesive applied on the side edges wherein two of the outermost boards of the plurality of boards are bonded only on one side edge by the adhesive to adjacent corresponding interior boards to form the prefabricated approach section of wooden boards, the prefabricated approach section having a thickness approximately the same as the bowling lane, which is a laminate floor.

23. The bowling alley flooring system of claim 22, wherein the prefabricated approach section has a thickness of approximately less 2¾ inches.

24. The bowling alley flooring system of claim 22, wherein the prefabricated approach section has a thickness of approximately ¾ inches.

25. The bowling alley flooring system of claim 22, wherein the prefabricated approach section has a width greater than the bowling lane.

26. The bowling alley flooring system of claim 22, wherein the adhesive is one of:

a. cold or hot pressed curing adhesive;

b. air drying PVA (Polyvinyl acetates) adhesive;

c. hot melt urethanes; and d. radiation curing adhesive.

27. The bowling alley flooring system of claim 26, further comprising a curable finish on the prefabricated approach section of wooden boards.

28. The bowling alley flooring system of claim 22, wherein the prefabricated approach section includes a an underlayment of at least one layer of medium density fiber (MDF) or high density fiber (HDF) board or oriented strand board (OSB) or high density particle board (HDP).

29. The bowling alley flooring system of claim 22, further comprising an integrated foul line of contrasting material bonded to an edge of the prefabricated approach section substantially perpendicular to the longitudinal axis.

30. The bowling alley flooring system of claim 22, wherein the prefabricated approach section includes drilled holes for the insertion of fasteners for fastening to a sub floor.

31. The system of claim 22, further comprising plugs for plugging the drilled holes.

32. The system of claim 22, further comprising contrasting dowels used as range finders.

33. A prefabricated flooring system adapted for use in a bowling center, comprising a plurality of wooden boards having a longitudinal axis, the plurality of wooden boards each having a long side edge and a short side edge, the short side edges of abutting wooden floors of the plurality of wooden floors having interleaved finger joints bonded together by an adhesive applied thereon and abutting wooden floors along the long sides being bonded together by an adhesive applied thereto with two of the outermost boards of the plurality of wooded boards being bonded only on one side edge by the adhesive to adjacent corresponding interior boards to form a preformed section of wooden boards, wherein the preformed section of wooden boards is at least a section of an approach area.

34. The system of claim 33, wherein remaining portions of the approach area are laminate boards of synthetic material or residual wood approach.

* * * * *